United States Patent [19]

Reid

[11] 4,307,581

[45] Dec. 29, 1981

[54] COOLER INSERT

[76] Inventor: Richard J. Reid, 2341 Sabine Way, Cordova, Calif. 95670

[21] Appl. No.: 148,840

[22] Filed: May 12, 1980

[51] Int. Cl.[3] ..... F25D 3/08

[52] U.S. Cl. ..... 62/457; 62/372; 62/530

[58] Field of Search ..... 62/457, 371, 372, 529, 62/530

[56] References Cited

U.S. PATENT DOCUMENTS

| | | | |
|---|---|---|---|
| 2,057,036 | 10/1936 | Korinsky | 62/457 X |
| 2,528,449 | 10/1950 | Norton | 62/530 X |
| 2,570,300 | 10/1951 | Acton | 62/457 |
| 2,663,157 | 12/1953 | Laramy | 62/457 X |
| 2,850,885 | 9/1958 | Mohr et al. | 62/372 |

FOREIGN PATENT DOCUMENTS

| | | | |
|---|---|---|---|
| 1032683 | 4/1953 | France | 62/457 |
| 1050538 | 9/1953 | France | 62/457 |

*Primary Examiner*—Lloyd L. King

*Attorney, Agent, or Firm*—Blair, Brown & Kreten

[57] ABSTRACT

An insert for an ice chest which includes a tubular body having open ends and apertured side and end walls arranged to be disposed within the interior of the chest with the lower end in supported engagement with the chest bottom wall, the interior of the chest being provided with one or more vertically spaced removable shelves for supporting foodstuffs and having a cross-sectional shape for defining a surrounding clearance space with the side wall of the chest in which ice is placed so that the air cooled by the ice passes through the apertures in the body walls to refrigerate the foodstuffs on the shelves while the ice is blocked from entering the interior of the tubular body wherein the foodstuffs are stored.

10 Claims, 5 Drawing Figures

FIG. 1
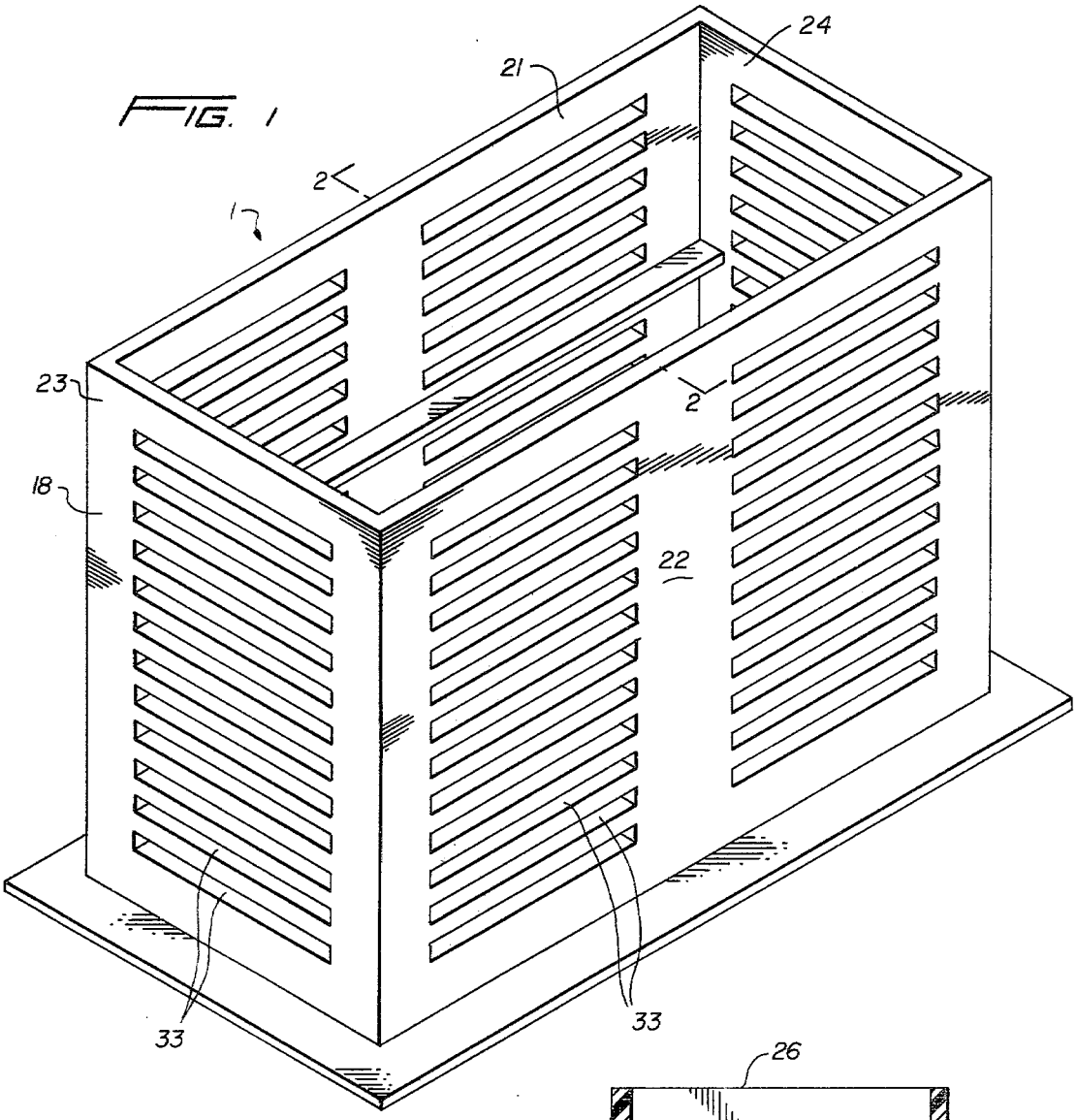
FIG. 2
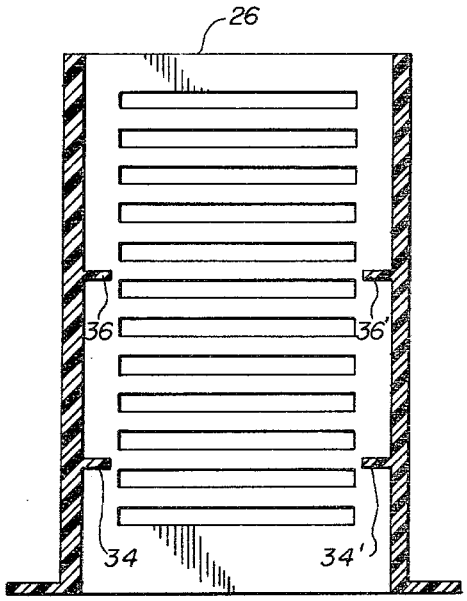
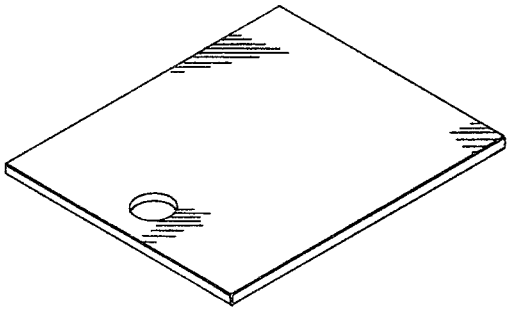
FIG 3

COOLER INSERT

BACKGROUND OF THE INVENTION

One of the most common devices in use today for maintaining foodstuffs in a refrigerated condition is that container know as a chest or cooler used by picnickers and the like. Such coolers are generally formed of insulating material such as expanded plastic foam molded in a one piece construction and having an access opening arranged to be closed by a lid of material similar to that of the cooler body. Foodstuffs such as beverages, sandwiches and the like are accommodated within the interior of the cooler and to maintain the foodstuffs in a refrigerated condition, ice is generally introduced together with the foodstuffs to provide temporary refrigerated storage of the foodstuffs until used.

One of the basic problems, however, encountered with the use of such coolers is the unavoidable melting of the ice however gradual so that even though only a portion of the ice may melt before use of the foodstuffs water collects in the cooler saturating at least some of the foodstuffs such as sandwiches, pastry, etc reducing if not destroying the palatability of the foodstuffs. Another problem is presented with the use of such coolers in that it is common to indiscriminately load ice into the cooler over and around the foodstuffs therein with the result that upon removal of some of the foodstuffs the ice immediately falls into the cavity which remains making it very difficult if not impossible for replacing an item such as a bottle of milk which is only partially used.

OBJECTS AND SUMMARY OF THE INVENTION

Accordingly, a primary object of this invention is to provide a new and novel insert for an ice chest or the like which permits the foodstuffs stored in the chest to remain segregated from the ice.

Another object of this invention is to provide a new and novel insert for an ice chest which maintains the foodstuffs in the chest free of contact with water produced by the melting ice.

A further object of this invention is to provide a new and novel insert for an ice chest which is simple and inexpensive in construction, which provides ready access to foodstuffs stored in the chest and which permits full advantage to be taken of the cooling affect of the ice in the chest without contact therewith.

Still another object of this invention is to provide a new and novel insert for an ice chest which permits the maximum cooling efficiency to be obtained from ice stored in the chest and which permits the storage of foodstuffs at various levels in a completely accessible manner through the access opening in the chest.

The objects of the invention an other related objects are accomplished by the provision of an insert for a foodstuffs container such as an ice chest formed of insulating material and having a bottom wall and side walls defining an interior together with an access opening arranged to be closed by a lid the chest interior being arranged to accommodate refrigerating materials such as ice. The insert includes a tubular body having upper and lower open ends and an interior and means are provided on the tubular body for removably supporting the tubular body in an upstanding position within the chest interior with the lower open end adjacent the chest bottom wall and with the open upper end adjacent the chest access opening. The tubular body is adapted to be disposed in space-apart relationship with the chest side wall to defind a surrounding clearance space in which ice is disposed and the tubular body is provided with apertures for circulating cooling air between the clearance space and the interior of the interior body. At least one shelf if removably supported within the tubular body interior above the body lower for supporting foodstuffs to be refrigerated by the cooling air within the chest.

The above-mentioned and other features and objects of the present invention will become more apparent by reference to the following description taken in conjunction with the accompanying drawings, wherein like reference numerals denote like elements.

BRIEF DESCRIPTION OF THE DRAWINGS

FIG. 1 is a perspective view of an insert constructed in accordance with the invention;

FIG. 2 is a sectional view taken substantially along line 2—2 of FIG. 1;

FIG. 3 is a perspective view of a shelf utilized in the insert of FIG. 1;

DESCRIPTION OF THE PREFERRED EMBODIMENT

Figure 4:
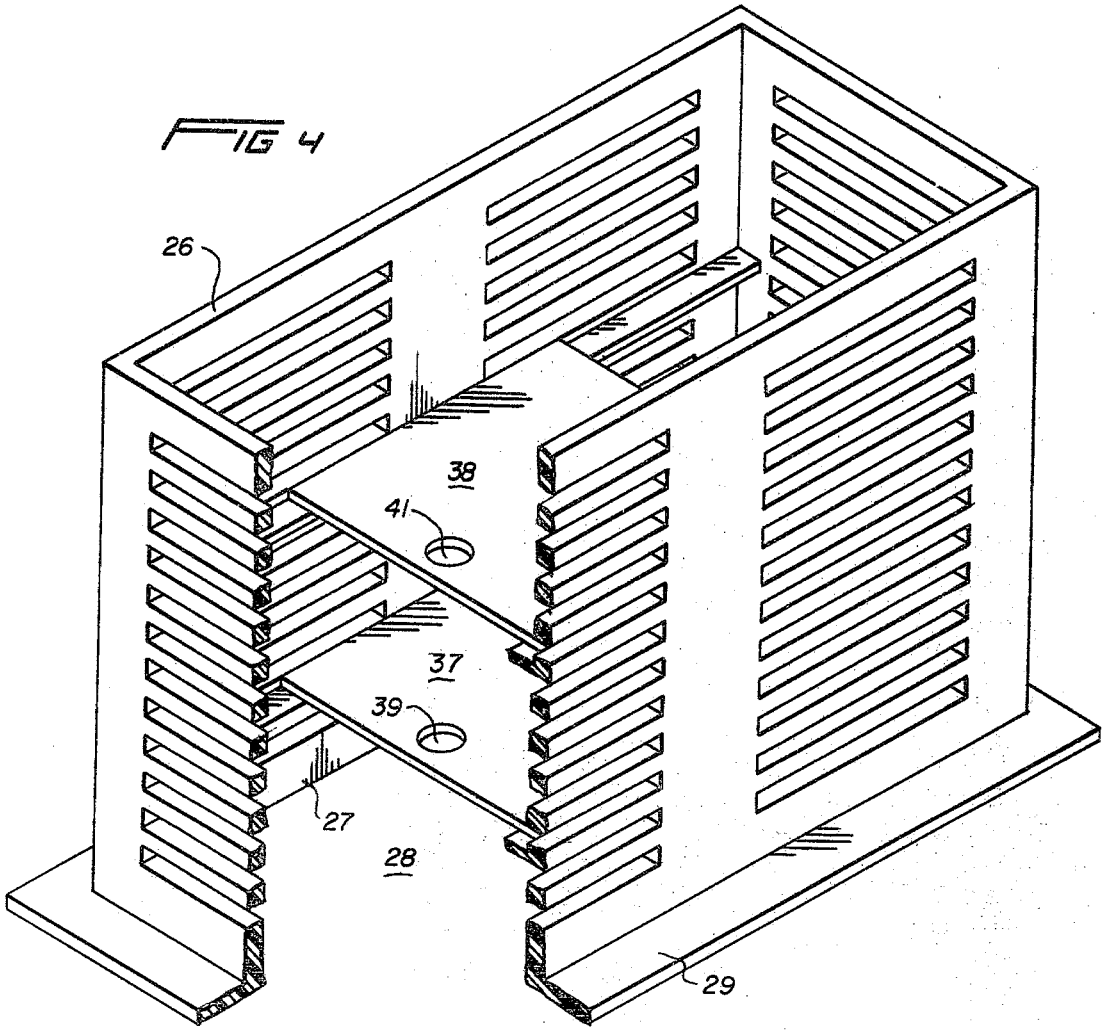
FIG. 4 is a view similar to FIG. 1 partially broken away.

Referring now to the drawings and to FIG. 1 in particular there is shown an insert constructed in accordance with the invention and designated generally by the letter 1. The insert 1 is adapted to be utilized with a cooler such as a ice chest of conventional construction designated generally in FIG. 5 by the letter C and showing two of such inserts 1 associated therewith. The cooler C may be of any well known type which is formed from insulting material such as expanded foam plastic and includes a side wall 11, a bottom wall 12 defining an interior 14. The cooler C also is provided with an access opening 16 arranged to be closed by a removable lid 17 also preferably formed of insulating material.

The insert 1 of the invention includes a tubular body 18 preferably of rectangular cross-sectional shape having a pair of oppositely disposed side walls 21, 22 and a pair of oppositely disposed end walls 23,24. The tubular body 18 is provided with an open upper end 26 and a open lower end 27 with the side walls 21, 22 and end walls 23, 24 defining an interior 28. Means are provided for removably supporting the tubular body 18 in an upstanding position within the interior 14 of the chest C with the open lower end of the tubular body 18 adjacent the chest bottom wall 12. More specifically, in the preferred embodiment, the tubular body 18 is provided with a laterally extending marginal flange 29 adjacent the lower open end 27 so that when the insert 1 is positioned inside the chest interior 14 the marginal flange 29 overlies the chest bottom wall 12 in supported engagement therewith.

In the preferred embodiment, the tubular body 18 together with the marginal flange 29 is preferably molded in a one piece construction of synthetic material such as a suitable plastic or the like and the tubular body 18 is provided with a cross-sectional shape such that the side walls 21, 22 and end walls 23, 24 define with the chest side wall 11 a clearance space 31 for accommodating refrigerating material such as ice 32 completely surrounding the insert 1.

The tubular body is provided with aperture means for circulating cooling air between the clearance space 31 and the tubular body interior 28. More specifically, each of the side walls 21, 22 and end walls 23, 24 are provided with a plurality of horizontally extending vertically spaced slots 33 throughwhich the cooling air chilled by the ice 32 may pass freely into the tubular body interior 28 for refrigerating foodstuffs stored within the body interior 28.

Shelf means are removably supported within the tubular body interior 28 above the tubular body lower end 27 on which foodstuffs to be refrigerated are supported. More specifically, in the illustrated embodiment, at least one pair preferably a plurality of pairs of oppositely disposed inwardly extending rails 34, 34' and 36, 36' are provided on the inner surface of the side walls 21, 22 respectively the pairs of rails 34, 34' and 36, 36' being arranged in vertically spaced relationship above the tubular body open end 27 as shown best in FIG. 2. Preferably, the rails 34, 34' and 36, 36' extend horizontally between the end walls 23, 24 are formed integrally with the tubular body 18.

Each of the pairs of rails 34, 34' and 36, 36' are arranged to support a substantially planar panel 37, 38 respectively each of the panels 37, 38 having a width corresponding substantially to the space between the tubular body side walls 21, 22 but having a length substantially smaller than the space in between the tubular body end walls 23, 24 to permit the panels to be disposed in a selected horizontal position along the rails.

Means are provided on the panels 37, 38 for providing a grip so that the panels may be removably disposed on the respective rails through the open upper end 26 of the tubular body 18. In the illustrated embodiment, such gripping means includes an aperture 39, 41 on the panels 37, 38 respectively through which a user's hand may be inserted for manipulating each of the panels.

Figure 5:
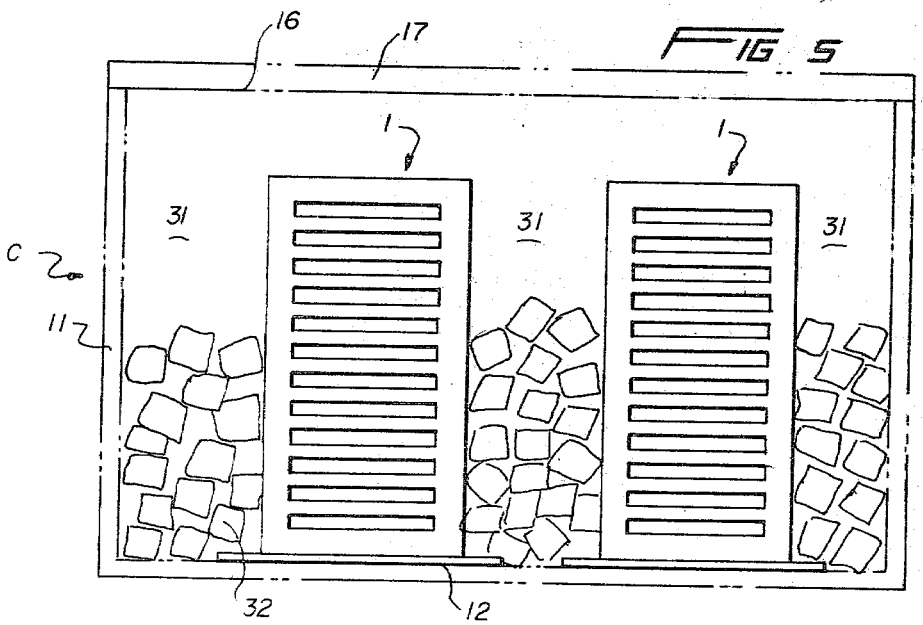
FIG. 5 is a side elevation view showing the interior of a cooler having two of the inserts of FIG. 1 disposed therein.

It should be understood that it is within the scope of the invention to utilize two or more such inserts 1 as shown in FIG. 5 the inserts 1, 1' being disposed in spaced relationship with each other and with the side wall 11 of the chest C. In the use of the invention, the inserts are appropriately positioned within the chest interior 14 as shown in FIG. 5 ice being introduced into the clearance space 31 surrounding relationship with the inserts 1, 1'. When the lid 17 of the cooler C is removed the shelves 37, 38 may then be positioned within the tubular body interior 28 in a selected horizontal position and foodstuffs stored thereon access to the interior of the tubular body is provided through the open upper end 26 and the chest access opening 16. Thus, the foodstuffs on the panel 37, 38 are refrigerated by the cooling air passing between the ice 32 through the slots 33 into the tubular body interior 28 and melted ice collecting within the bottom of chest C is maintained below the lowest level or panel 37 on which the foodstuffs are stored. It should be further understood that although both of the shelves 37, 38 may be stacked with stored foodstuffs, shelf 38 may be moved horizontally relative to panel 37 permitting access to the foodstuffs stored on panel 37 without disturbing the foodstuffs on panel 38.

Having thus described the preferred embodiment of the invention it should be understood that numerous structural modifications and adaptations may be resorted to without departing from the spirit of the invention.

What is claimed is:

1. An insert for a cooler of insulating material such as an ice chest or the like for the storage of foodstuffs having a bottom wall and a side wall defining an interior for accommodating refrigerating material such as ice and an access opening adapted to be closed by a closure comprising, in combination, a tubular body for removably supporting said tubular body in an upstanding position within said chest interior with said lower open end adjacent said chest bottom wall and with said open upper end adjacent said chest access opening so that said tubular body is disposed in spaced-apart relationship with said chest side wall to define a clearance space surrounding said tubular body for accommodating a refrigerating material such as ice, wherein said supporting means for said tubular body comprises a laterally extending marginal flange on said tubular body adjacent said lower open end for overlying engagement with said chest bottom wall, said tubular body being provided with aperture means for curculating cooling air between said clearance space and said tubular body interior and shelf means removably supported within said tubular body interior above said lower end for supporting foodstuffs to be refrigerated by said cooling air within said chest.

2. An insert in accordance with claim 1 wherein said tubular body is of rectangular cross-sectional shape having a pair of oppositely disposed side walls and a pair of oppositely disposed end walls.

3. An insert in accordance with claim 2 wherein said tubular body is formed in a one-piece construction of molded plastic material.

4. An insert in accordance with claim 3 wherein said aperture means comprises a plurality of horizontally extending slots arranged in vertically spaced relationship in said tubular body side and end walls.

5. An insert in accordance with claim 4 wherein said shelf means comprises at least one pair of inwardly extending, oppositely disposed rails mounted on said tubular body side walls within said interior intermediate the open ends of said tubular body and a substantially planar imperforate panel having a width corresponding substantially to the spacing between said tubular body side walls removably positioned on said rails.

6. An insert in accordance with claim 5 wherein said rails are formed integrally with said tubular body side walls.

7. An insert in accordance with claim 6 wherein said panel has a length substantially less than the spacing between said tubular body end walls to permit said panel to be disposed in a selected horizontal position on said rails between said end walls.

8. An insert in accordance with claim 7 wherein said shelf means comprises a plurality of said pairs of inwardly extending, oppositely disposed rails mounted on said tubular body side walls within said interior, said plurality of pairs of rails being arranged in vertically spaced relationship, each of said pairs of rails being arranged to removably accommodate one of said panels.

9. An insert in accordance with claim 8 including gripping means on each of said panels for permitting said panels to be removably disposed on said respective pair of rails through said tubular body open upper end.

10. The insert in accordance with claim 9 wherein said gripping means comprises at least one aperture on said panel dimensioned to receive a hand portion to provide a purchase area.

* * * * *